US011391224B2

(12) United States Patent
Jeon et al.

(10) Patent No.: US 11,391,224 B2
(45) Date of Patent: Jul. 19, 2022

(54) COMPRESSION-RELEASE TYPE ENGINE BRAKE

(71) Applicants: HYUNDAI MOTOR COMPANY, Seoul (KR); KIA MOTORS CORPORATION, Seoul (KR)

(72) Inventors: Jae Hee Jeon, Hwaseong-si (KR); Won Seok Lee, Goyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 23 days.

(21) Appl. No.: 16/995,461

(22) Filed: Aug. 17, 2020

(65) Prior Publication Data

US 2021/0102505 A1 Apr. 8, 2021

(30) Foreign Application Priority Data

Oct. 7, 2019 (KR) ..... 10-2019-0123906

(51) Int. Cl.

| | |
|---|---|
| ***F01L 1/18*** | (2006.01) |
| ***F02D 13/04*** | (2006.01) |
| ***F02D 13/02*** | (2006.01) |
| ***F01L 13/06*** | (2006.01) |

(52) U.S. Cl.

CPC ..... *F02D 13/04* (2013.01); *F01L 1/18* (2013.01); *F01L 13/06* (2013.01); *F02D 13/0242* (2013.01); *F01L 1/181* (2013.01); *F01L 13/065* (2013.01); *F01L 2305/00* (2020.05)

(58) Field of Classification Search

CPC ..... F01L 13/065; F01L 13/06; F01L 1/181; F01L 1/18; F01L 2305/00; F02D 13/04; F02D 13/0242

See application file for complete search history.

(56) References Cited

U.S. PATENT DOCUMENTS

| | | | | |
|---|---|---|---|---|
| 9,200,541 | B2 * | 12/2015 | Roberts | F01L 9/12 |
| 9,732,642 | B2 * | 8/2017 | Lee | F01L 13/065 |
| 10,794,242 | B2 * | 10/2020 | Persson | F01L 1/181 |
| 10,883,392 | B2 * | 1/2021 | Gron, Jr. | F01L 1/26 |
| 11,047,271 | B2 * | 6/2021 | Jeon | F01L 1/46 |
| 11,105,230 | B2 * | 8/2021 | Kim | F01L 1/267 |
| 11,156,135 | B2 * | 10/2021 | Baltrucki | F01L 1/267 |
| 2010/0307451 | A1 * | 12/2010 | Lee | F02D 13/04 123/321 |
| 2020/0018243 | A1 * | 1/2020 | Baltrucki | F01L 13/065 |

FOREIGN PATENT DOCUMENTS

KR 10-1552489 B1 9/2015

* cited by examiner

*Primary Examiner* — Gonzalo Laguarda

(74) *Attorney, Agent, or Firm* — Lempia Summerfield Katz LLC

(57) ABSTRACT

A compression-release engine brake for opening an exhaust valve at an end of a compression stroke for performing braking function includes: an exhaust rocker arm, a valve bridge that is connected to a pair of exhaust valves, and of which a pair of rotation preventers protruded outward are formed the valve bridge, a socket module includes a housing in which a first space where the engine brake oil flows in and a second space where the engine brake oil is exhausted and a reset valve is disposed are formed, and the socket module whose length become longer relatively according to the inflow of the engine brake oil, and a reset guide module selectively pushing the reset valve to exhaust the engine brake oil inside the housing.

12 Claims, 12 Drawing Sheets

B - B

FIG. 12 "PRIOR ART"
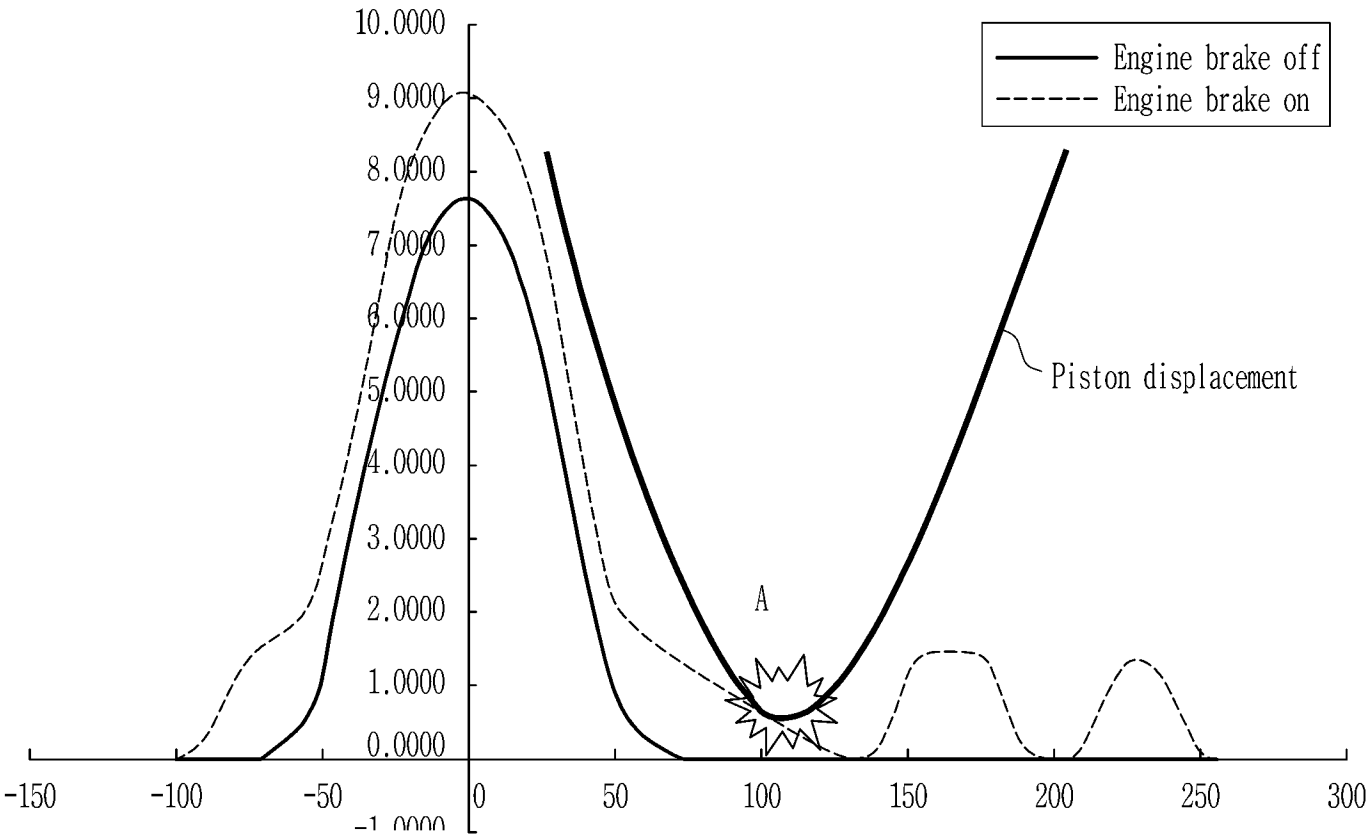

COMPRESSION-RELEASE TYPE ENGINE BRAKE

CROSS-REFERENCE TO RELATED APPLICATION

This application claims priority to and the benefit of Korean Patent Application No. 10-2019-0123906, filed on Oct. 7, 2019, the entire contents of which are incorporated herein by reference.

FIELD

The present disclosure relates to a compression-release engine brake.

BACKGROUND

The statements in this section merely provide background information related to the present disclosure and may not constitute prior art.

In general, a brake system of an internal combustion engine vehicle uses a hydraulic pressure type of brake, but the engine brake is used to prevent premature abrasion of a brake pad during downhill driving or frequent sudden stops.

The compression-release engine brake device (namely, compression-release engine brake), which is a type of engine brake, temporarily opens an exhaust valve near a compress top dead center of a piston during the basic four strokes of the engine, i.e., exhausts compressed air in a cylinder out of the cylinder to thereby obtain a braking effect by inducing a pumping loss of an expansion stroke.

In a compression-release engine brake according to a conventional art, a socket module is applied between a valve bridge connected with a pair of exhaust valves, and an exhaust rocket arm.

In the socket module, the brake piston is provided inside the housing where the brake oil is introduced, and when the engine brake is operated, the brake piston moves downward to eliminate the gap between the exhaust rocker arm and the exhaust cam, thereby forcing the exhaust valve to be opened at the end of the compression stroke.

The exhaust valve is opened at the end of the compression stroke by the socket module to add braking force to the vehicle, but once the engine brake oil is introduced into the socket module, it is not exhausted, and thus the valve may be opened more by oil pressure formed in the socket module.

FIG. 12 is a graph that shows a valve lift displacement amount occurring in a conventional compression-release engine brake.

As shown in FIG. 12, there is a possibility of occurrence of a contact "A" between an exhaust valve and an engine piston.

In order to solve such a problem, the compression-release engine brake with a reset bracket is provided on one side of the socket module, and the reset bracket must be applied to the outside of the reset module as well, and thus there is a drawback in which the overall size increases.

In addition, the compress relaxation engine brake device according to the conventional art has a problem that the socket module rotates between the valve bridge and the exhaust rocker arm during continuous operation.

The above information disclosed in this Background section is only for enhancement of understanding of the background of the present disclosure, and therefore it may contain information that does not form the prior art that is already known to a person of ordinary skill in the art.

SUMMARY

An exemplary form of the present disclosure provides a compression-release engine brake that can automatically initialize a pressure inside a socket module by automatically exhausting the engine brake oil that has been introduced into the socket module during engine brake operation and prevents collision between exhaust valve and engine piston In one or a plurality of exemplary forms of the present disclosure, the compression-release engine brake temporarily may open an exhaust valve at the end of the compression stroke, that is, near a top dead center of the piston, to exhaust compressed air in a cylinder to the outside the cylinder, thereby acquiring a braking effect by inducing a pumping loss in the expansion stroke.

In one form of the present disclosure, a compression-release engine brake for opening an exhaust valve at an end of a compression stroke of an engine may include: an exhaust rocker arm that rotates around a rocker arm shaft by a rotation of an exhaust cam that selectively contacts a roller mounted at one end of the exhaust rocker arm; a valve bridge that is disposed on the other end of the exhaust rocker arm, and is connected to a pair of exhaust valves, where the valve bridge includes a pair of rotation preventers protruded outward; a socket module that is disposed between the exhaust rocker arm and includes a housing configured to form a first space in which engine brake oil flows in through an inlet, a second space from which the engine brake oil is exhausted through an outlet; a reset valve partially inserted in the second space of the housing, and a reset guide module mounted on an upper part of a cylinder head, and selectively pushing the reset valve inside of the housing to exhaust the engine brake oil.

The pair of rotation preventers of the valve bridge may be protruded toward the outside from a central portion of the valve bridge, and formed to extend a certain length upward so that the part corresponding to the second space of the socket module is inserted.

The socket module further may include a brake piston moved in the up and down direction by the engine brake oil inserted into the first space, and contacting an upper surface of the valve bridge.

An upper and a lower protrusion may be formed on each exterior surface of the brake piston, and wherein, the compression-release engine brake may further include a stopper fitted to a side of the housing in correspondence between the upper protrusion and the lower protrusion.

The stopper may include a head portion and a body portion, and wherein, the body portion may be mounted to the housing, and an end of the head portion is protruded into the first space by a predetermined length to be positioned between the upper and lower protrusions.

The housing may further include a rounded mounting groove protruded upward from an upper center of the housing where an adjusting screw mounted to one end of the exhaust rocker arm is mounted.

Penetration holes in response to the second space may be formed in the housing on both sides in contact with the rotation preventer, and a part of the engine brake oil may be exhausted through the penetration hole.

The compression-release engine brake may further include a check valve provided in the first space to open and close the inlet.

The compression-release engine brake may further include a check spring provided on the upper portion of the brake piston to elastically support the check valve.

The reset valve may have a flow path groove that is concave inward from an upper exterior circumference of the reset valve, and wherein The compression-release engine brake may further include a reset spring elastically supports the reset valve.

An upper end of the oil passing groove may be caught on a slanted surface formed in the second space for preventing the reset valve from deviating downward.

The reset valve may open the outlet when the reset valve contacts with the guide rod.

The reset guide module may include a guide plate in which the pair of exhaust valves are fitted and seated on the upper part of the cylinder head, and a connection bracket is formed, and a guide rod mounted on the connecting bracket and selectively pushing the reset valve.

The compression-release engine brake according to an exemplary form of the present disclosure may automatically exhaust the brake oil introduced into socket module during engine brake operation by being provided with the reset guide module such that it is possible to prevent the exhaust valve from contacting the engine piston.

In addition, compression-release engine brake according to an exemplary form of the present disclosure may prevent wear of the socket module by exhausting a portion of the engine brake oil toward the reset guide module.

In addition, compression-release engine brake according to an exemplary form of the present disclosure may prevent rotation of the socket module during engine brake operation by applying a rotation preventer to one side of the valve bridge.

In addition, effects obtained or predicted by the exemplary forms of the present disclosure are disclosed directly or implicitly in a detailed description of an exemplary form of the present disclosure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
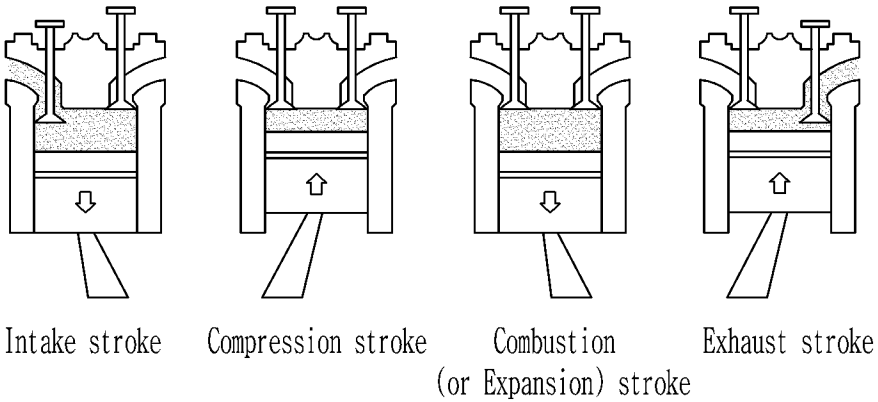
FIG. 1 is a schematic diagram of a basic four-stroke cycle of an engine.

FIG. 8 to FIG. 11 sequentially illustrate an operation method of the compression release type engine brake according to another exemplary form of the present disclosure; and FIG. 12 is a graph that shows a valve lift displacement amount occurring in use of a general compression-release engine brake.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As those skilled in the art would realize, the described forms may be modified in various different ways, all without departing from the spirit or scope of the present disclosure.

In the following description, dividing names of components into first, second, and the like is to divide the names because the names of the components are the same as each other, and an order thereof is not particularly limited.

Figure 2:
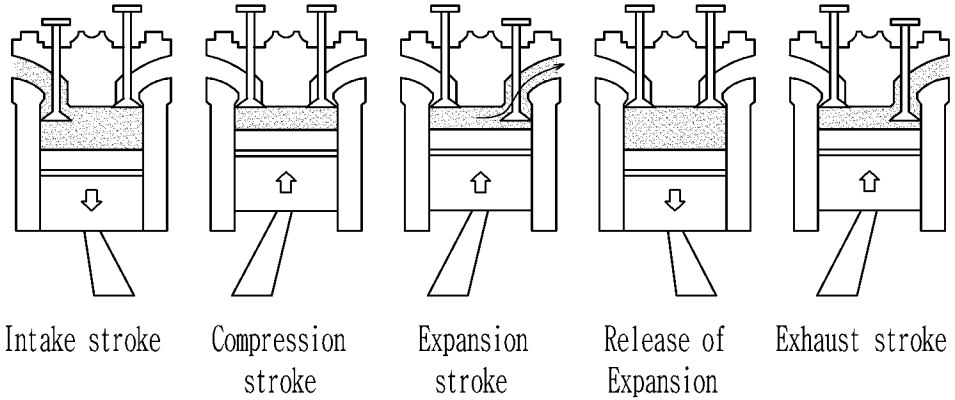
FIG. 2 is a schematic diagram of an engine cycle for description of a compression-release engine brake according to an exemplary form of the present disclosure.

FIG. 1 is a schematic diagram of a basic four-stroke cycle of an angle, and FIG. 2 is a schematic diagram of an engine cycle for description of a compression-release engine brake according to an exemplary form of the present disclosure.

In general, the engine brake may be applied to prevent the vehicle from causing premature wear of the brake pads applied to the foot brake when driving downhill or when frequently stopping suddenly.

The compression-release engine brake is actuated in one of the four basic strokes of the engine, and opens an exhaust valve at the end of a compression stroke so that the engine can perform its braking function.

Referring to FIG. 1, a vehicle engine is driven by repeating a four-stroke cycle of intake, compression, combustion, and exhaust when driving.

As shown in FIG. 2, the compression-release engine brake temporarily opens an exhaust valve at the end of the compression stroke, that is, near a top dead center of the piston, to exhaust compressed air in a cylinder to the outside the cylinder, thereby acquiring a braking effect by inducing a pumping loss in the expansion stroke.

For this, the compression-release engine brake according to the exemplary form of the present disclosure may be formed as follows.

Figure 3:
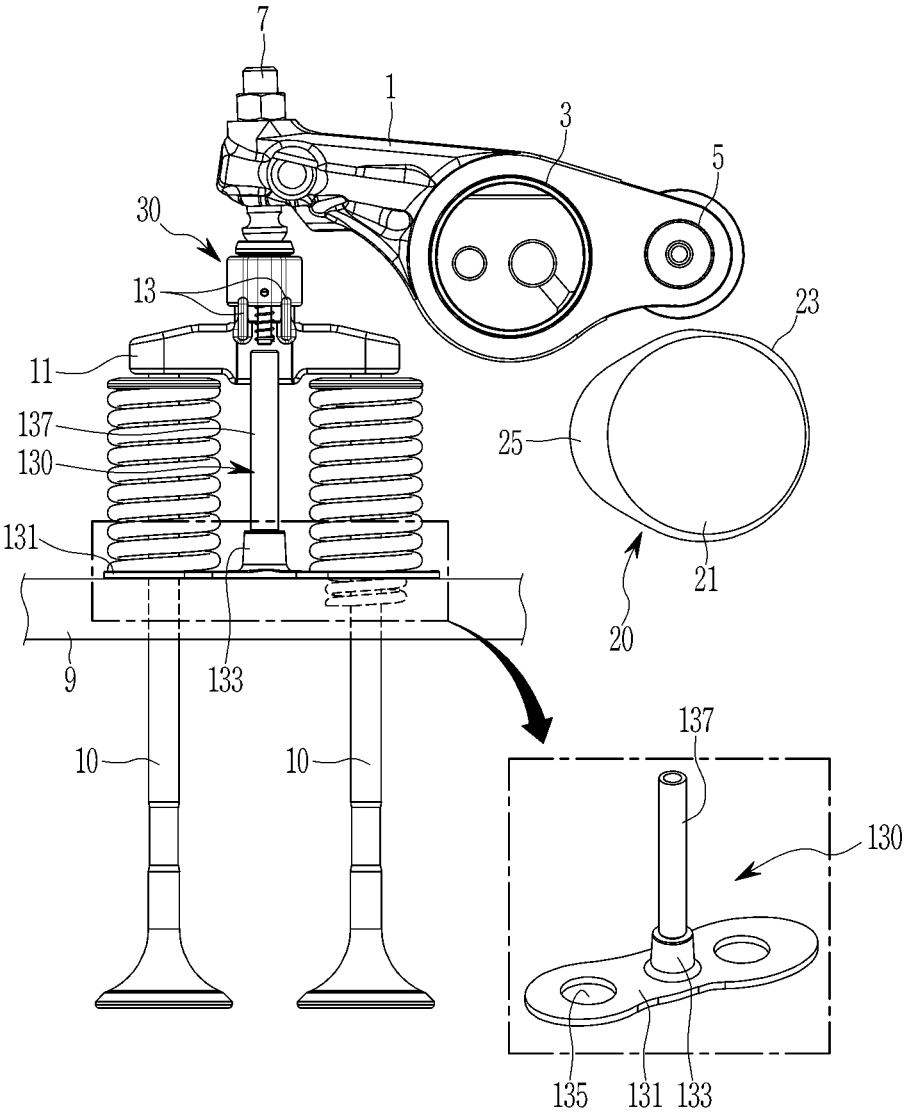
FIG. 3 is a schematic diagram of the compression-release engine brake according to the exemplary form of the present disclosure.

FIG. 3 is a schematic diagram of the compression-release engine brake according to an exemplary form of the present disclosure.

Referring to FIG. 3, in the compression release type engine brake, a rocker arm shaft 3 is inserted into an exhaust rocker arm 1 such that the exhaust rocker arm 1 rotates with respect to the rocker arm shaft 3, a roller 5 is mounted to one end of the exhaust rocker arm 1, and an adjusting screw 7 is mounted to the other end of the exhaust rocker arm 1.

The roller 5 may contact or not contact an exhaust cam 20 installed on a camshaft.

The adjusting screw 7 is mounted to the other end of the exhaust valve 10 and is thus connected with a valve bridge 11 through a socket module 30 provided at a lower end thereof.

The valve bridge 11 is connected to the exhaust valve 10, and the exhaust valve 10 may be provided as a pair.

In addition, the exhaust cam 20 may be divided into a brake cam lobe section and a main cam lobe section according to a profile, and the brake cam lobe section and the main cam lobe section may be implemented by forming a brake cam lobe 23 and a main cam lobe 25 on the exhaust cam shaft 21.

The main cam lobe 25 may implement the exhaust stroke by contacting the roller 5, and the brake cam lobe 23 may open the exhaust valve 10 by contacting the roller 5 when the engine brake is operated.

In addition, a bias spring (not shown) is mounted to the exhaust rocker arm 1, and the bias spring lifts one end of the exhaust rocker arm 1, which corresponds to the roller 5, and the same time, provides an elastic force in a direction in which the other end of the exhaust rocker arm 1, which corresponds to the adjusting screw 7, to be closely attached to the valve bridge 11.

Accordingly, in a state before the engine brake operation (in the basic engine stroke), the roller 5 maintains a distance with the brake cam lobe 23 of the exhaust cam 20, and, in the exhaust stroke, the roller 5 is pushed upward only by the main cam lobe 25 of the exhaust cam 20.

That is, when brake oil for operation of the engine brake is not supplied, a gap is formed between the roller 5 provided at the other end of the exhaust rocker arm 1 and the exhaust cam 20 and thus the brake cam lobe 23 of the exhaust cam 20 and the roller 5 do not contact each other, thereby causing the engine brake not to work.

On the other hand, when the engine brake oil is supplied to operate the engine brake, the socket module 30 lifts the other side of the exhaust rocker arm 1 up such that the roller 5 and the exhaust cam 20 are in constant contact, and thus, at the end of the compression stroke, the exhaust rocker arm 1 is operated by the brake cam lobe 23 of the exhaust cam 20, so that the braking effect can be obtained.

The socket module 30 is applied between the exhaust rocker arm 1 and the valve bridge 11.

Figure 4:
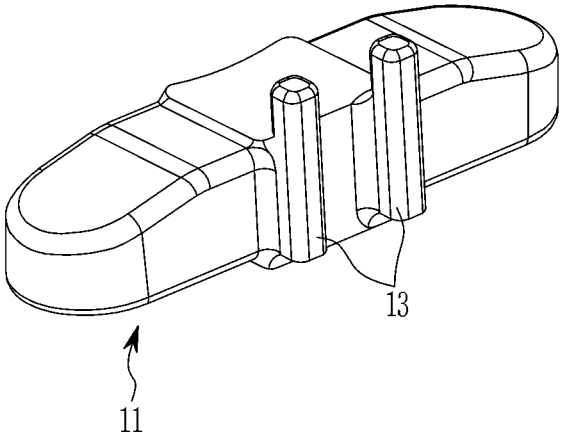
FIG. 4 is a perspective view of a valve bridge applied to the compression-release engine brake in one form of the present disclosure.

FIG. 4 is a perspective view of a valve bridge applied to the compression-release engine brake in one exemplary form of the present disclosure.

Referring to FIG. 4, a rotation preventer 13 that prevents rotation of the socket module 30 may be formed on the valve bridge 11, and the rotation preventer 13 may be formed in pairs.

The rotation preventer 13 is protruded toward the outside on the central portion of one side of the valve bridge 11.

The rotation preventer 13 is formed in a pair and is formed along the up and down directions so that the portion corresponding to the second space 50 of the socket module 30, which will be described below, is fitted and fixed.

That is, the socket module 30 can be inserted between the rotation preventers 13 of the valve bridge 11.

Figure 5:
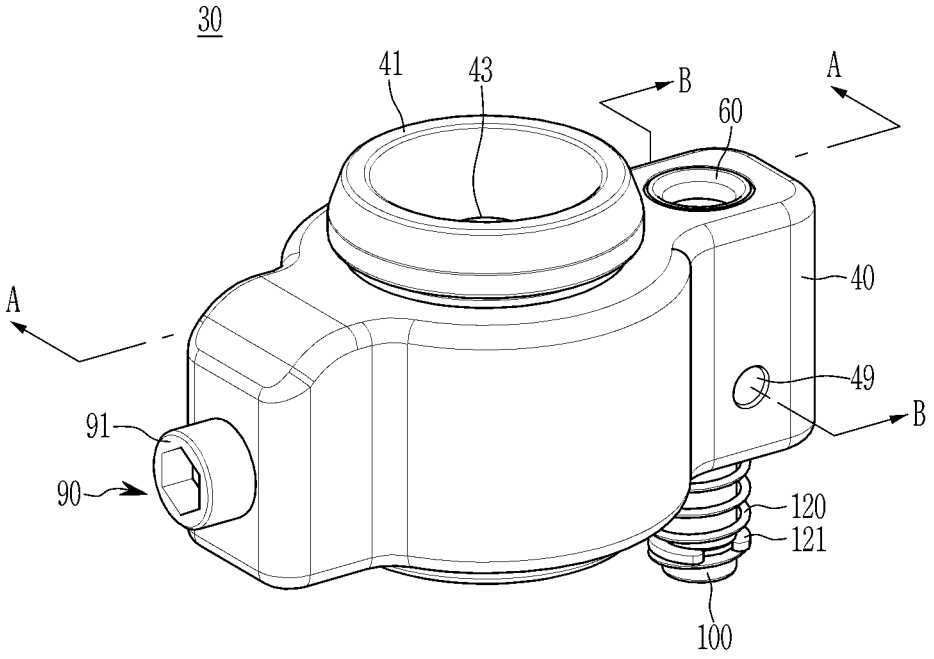
FIG. 5 is a perspective view of the socket module applied to the compression-release engine brake in one form of the present disclosure.
Figure 6:
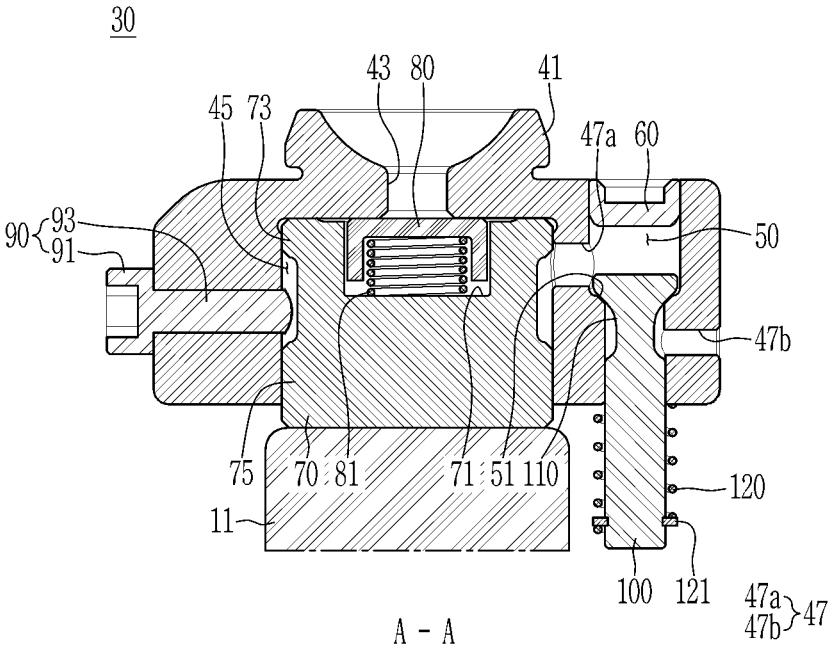
FIG. 6 is a cross-sectional view of FIG. 5, taken along the line A-A.
Figure 7:
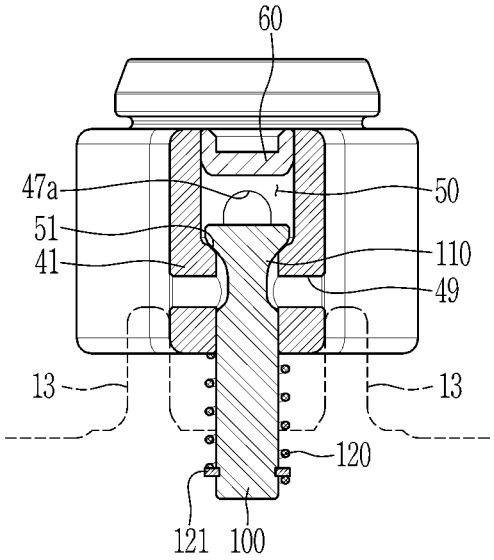
FIG. 7 is a cross-sectional view of FIG. 5, taken along the line B-B.

FIG. 5 is a perspective view of the socket module applied to the compression-release engine brake according to the exemplary form of the present disclosure, FIG. 6 is a cross-sectional view of FIG. 5, taken along the line A-A, and FIG. 7 is a cross-sectional view of FIG. 5, taken along the line B-B.

Referring to FIG. 5 to FIG. 7, the socket module 30 applied to the compression-release engine brake includes a housing 40, a brake piston 70, and a reset valve 100.

In one form, the housing 40 forms a first space 45 in which the engine brake oil flows in through an inlet 43, and a second space 50 from which the engine brake is exhaust through an outlet 47.

The housing 40 includes a mounting portion 41 that protrudes upward from a center of an upper center thereof. The mounting portion 41 includes a rounded mounting groove provided therein such that the adjusting screw 7 is mounted thereto.

That is, the adjusting screw 7 is configured to be seated on the mounting portion 41 and not detached from the mounting portion 41.

Also, the mounting portion 41 communicates with the first space 45 through the inlet 43.

The inlet 43 is configured to be opened and closed by a check valve 80.

The check valve 80 is elastically supported by a check spring 81 disposed inside a receiving groove 71 formed in the center of the upper surface of the brake piston 70.

The first space 45 communicates with the second space 50 through a first outlet 47*a*.

In the second space 50, the first outlet 47*a* connected to the first space 45, a second outlet 47*b* lower and parallel to the first outlet 47*a*, and penetration holes 49 lower vertical direction with the first outlet 47*a* are formed.

Penetration holes 49 are formed on both side surfaces of the housing 40 corresponding to the second space 50. The rotation preventers 13 contact the side surfaces, and a part of the engine brake oil is leaked through the penetration holes 49 for lubrication.

The top of the second space 50 can be closed by a cap 60.

The brake piston 70 is inserted into the first space 45 of the housing 40 to make contact with the upper surface of the valve bridge 11.

The brake piston 70 is provided to be movable up and down in the first space 45 by the engine brake oil flowing into the housing 40.

An upper protrusion 73 and a lower protrusion 75 are formed on each exterior surface of the brake piston 70.

Positions of the brake piston 70 is limited by a stopper 90 fitted to the housing 40 in correspondence between the upper protrusion 73 and the lower protrusion 75.

The stopper 90 includes a head portion 91 and a body portion 93.

When the stopper 90 is mounted, an end of the body portion 93 is inserted through the housing and then positioned between the upper and lower protrusions 73 and 75. Since the end of the stopper 90 is positioned between the upper protrusion 73 and the lower protrusion 75 of the brake piston 70, the stopper 90 is configured to limit the position of the brake piston 70.

The stopper 90 can adjust the insert length of the body portion 93 in the form of a screw.

A reset valve 100 is inserted into the second space 50 of the housing 40.

In the reset valve 100, an oil passing groove 110 is formed in an exterior circumference on the upper side inserted into the second space 50.

In the reset valve 100, a stepped surface is formed at the upper end by the oil passing groove 110, which is hung on a slanted surface 51 formed by the first outlet 47*a* and the second outlet 47*b* in the second space 50 so that the reset valve 100 is connected to the housing 40. That is, the reset valve 100 is caught in the second space 50 for preventing the reset valve 100 from deviating downward.

And the reset valve 100 is elastically supported by a reset spring 120.

The reset spring 120 is supported on a lower side by a spring pin 121 fixed to the reset valve 100.

The reset valve 100 performs an upward operation to open the outlet 47, and then returns to close the outlet 47 by the restoring force of the reset spring 120.

A reset guide module 130 is configured on the lower side corresponding to the reset valve 100 described above.

Referring to FIG. 3, the reset guide module 130 includes a guide plate 131 and a guide rod 137.

In the guide plate 131, mount holes 135 are formed so that the a pair of exhaust valves 10 are inserted on both sides of the length direction, and a connecting bracket 133 is formed in the center of the upper surface.

The guide plate 131 fits on a pair of exhaust valve 10 through the mount hole 135 and rests on the cylinder head 9.

The guide rod 137 is mounted on the connecting bracket 133. The guide rod 137 may be a hollow shape, and a part of the reset valve 100 can be inserted therein.

When the socket module 30 descends and the exhaust valve 10 is opened, the guide rod 137 pushes the reset valve 100 and the reset spring 120 is compressed, so that the reset valve 100 rises and the outlet 47 opens.

At this time, as the outlet 47 is opened, the engine brake oil inflowed into the housing 40 is exhausted, and the pressure inside the housing 40 can be returned to an initial state.

When the reset valve 100 is inserted into the guide rod 137, part of the engine brake oil exhausted from the penetration hole 49 passes through the rotation preventer 13 and flows in between the reset valve 100 and the guide rod 137.

The compression-release engine brake configured as described above is operated as follows.

FIG. 8 to FIG. 11 sequentially illustrate an operation method of the compression release type engine brake according to the exemplary form of the present disclosure.

Figure 8:
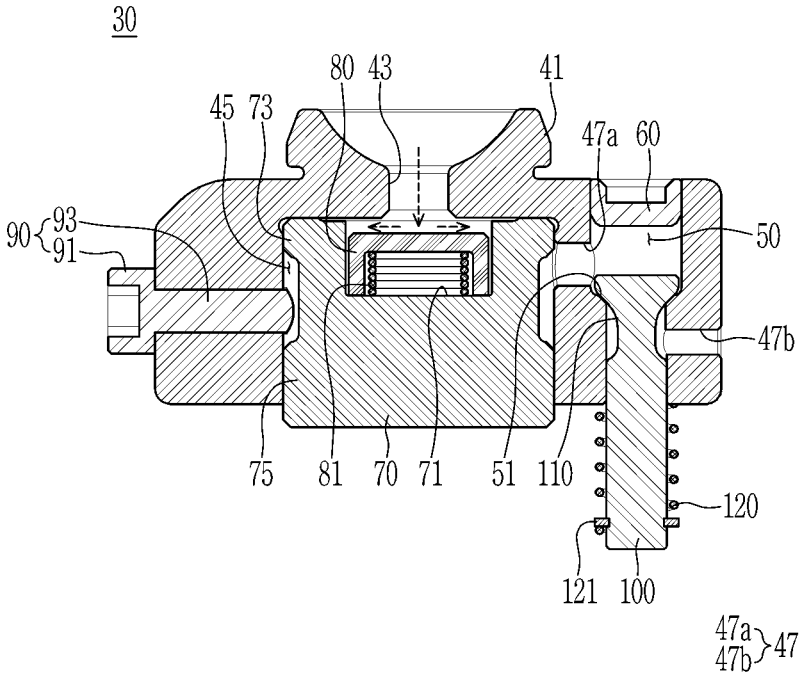

Referring to FIG. 8, when the engine brake is operated, the brake oil flows through a flow path inside the adjusting screw 7 to the inlet 43 of the housing 40.

Then, the check valve 80 that opens and closes the inlet 43 descends to open the inlet 43 and then the engine brake oil is inflow into the first space 45 of the housing 40.

Figure 9A:
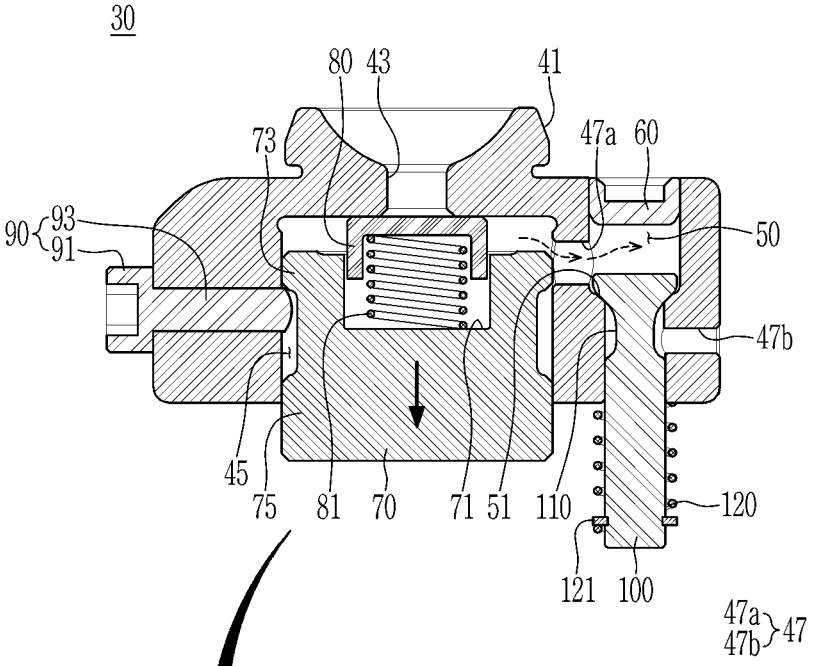
Figure 9B:
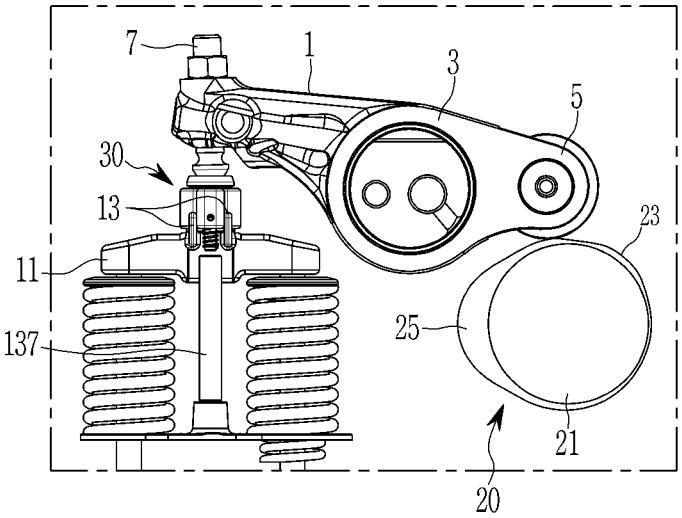

Referring to FIGS. 9A and 9B, when brake oil is introduced into the first space 45, the brake piston 70 descends by the hydraulic pressure and, at the same time, the check valve 80 closes the inlet 43 by an elastic force of the check spring 81 such that the first space 45 is closed and sealed.

As the brake piston 70 descends, the overall length of the up and down direction of the socket module 30 becomes longer, and thus, the end corresponding to the socket module 30 of the exhaust rocker arm 1 is pushed upwards to rotate the exhaust rocker arm 1 with respect to the rocker arm shaft 3.

Subsequently, the roller 5 of the exhaust rocker arm 1 and the exhaust cam 20 make contact.

When the exhaust cam 20 rotates and thus the brake cam lobe 23 of the exhaust cam 20 and the roller 5 contact each other, an end portion of the exhaust rocker arm 1, corresponding to the roller 5, is lifted upward and rotates with reference to the rocker arm shaft 3 by the protruded brake cam lobe 23.

Due to such an operation, the valve bridge 11 is pressed downward and the exhaust valve 10 is opened. At the end of the compress stroke, that is, the exhaust valve 10 is temporarily opened near the top dead center to exhaust the compressed air in the cylinder out of the cylinder, thereby inducing a pumping loss of the expansion stroke to obtain a braking effect.

Figure 10:
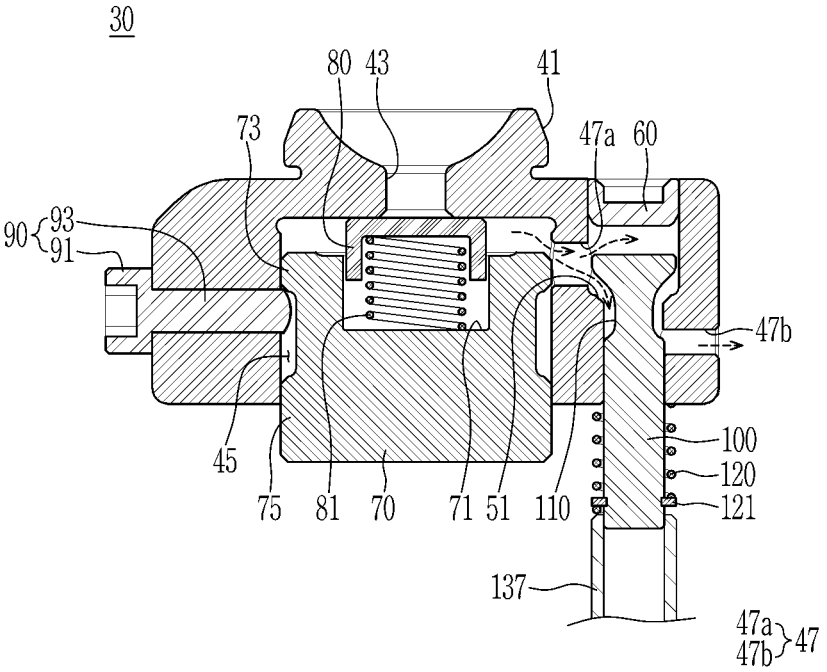

Referring to FIG. 10, as the exhaust rocker arm 1 rotates, the guide rod 137 pushes the reset valve 100 and the reset valve 100 moves relative to the upward.

Accordingly, the first outlet 47*a* and the second outlet 47*b* are opened through the oil passing groove 110 of the reset valve 100.

The engine brake oil inflow to the first space 45 is exhausted through the opened first outlet 47*a* and second outlet 47*b*.

Figure 11:
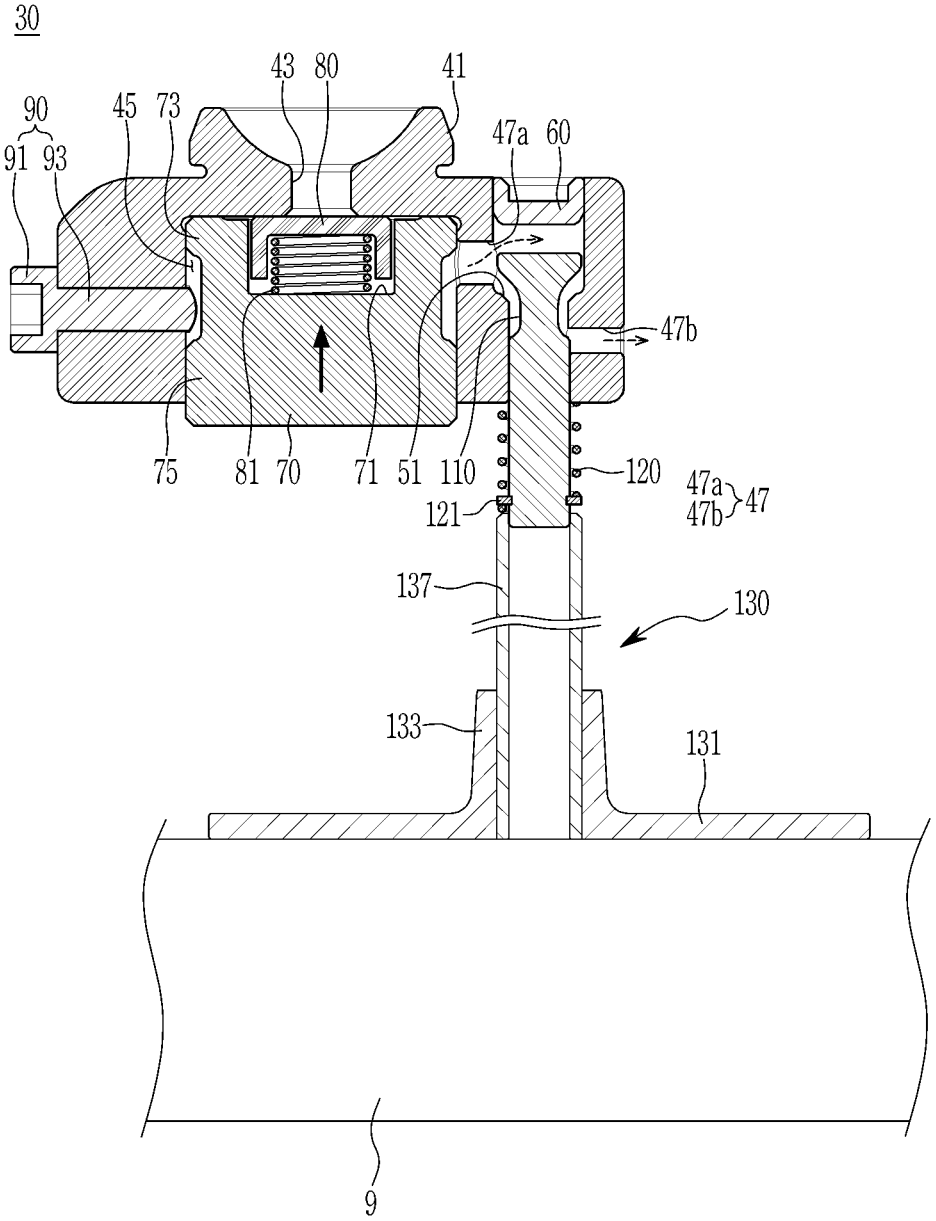

Referring to FIG. 11, when the engine brake oil is completely exhausted inside the housing 40, the brake piston 70 moves upward and returns to its original position, and the reset valve 100 is also automatically returned to its initial state, a certain gap between the roller 5 and exhaust cam 20 may be maintained.

Accordingly, the compression-release engine brake according to an exemplary form of the present disclosure may automatically initialize the internal pressure of the socket module 30 by exhausting the engine brake oil supplied inside the socket module 30 after opening the exhaust valve 10.

So that it is possible to prevent the exhaust valve 10 from contacting the engine piston.

Further, the reset valve 100 is inserted inside the guide rod 137, and the penetration holes 49 are formed in the housing 40 to allow the engine brake oil through the penetration holes 49 to be supplied between the reset valve 100 and guide rod 137.

In addition, the compression-release engine brake according to an exemplary form of the present disclosure can prevent rotation of the socket module 30 during engine brake operation by applying rotation preventer 13 to one side of the valve bridge 11.

The engine brake oil exhausted through the penetration holes 49 of the housing 40 can also act as a lubricant between the housing 40 and rotation preventer 13.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the appended claims.

<Description of symbols>

| | |
|---|---|
| 1: exhaust rocker arm | 3: rocker arm shaft |
| 5: roller | 7: adjusting screw |
| 9: cylinder head | 10: exhaust valve |
| 11: valve bridge | 13: rotation preventer |
| 20: exhaust cam | 21: exhaust camshaft |
| 23: brake cam lobe | 25: main cam lobe |
| 30: socket module | 40: housing |
| 41: mounting portion | 43: inlet |
| 45: first space | 47: outlet |
| 49: penetration hole | 50: second space |
| 51: slanted surface | 60: cap |
| 70: brake piston | 71: receiving groove |
| 73: upper protrusion | 75: lower protrusion |
| 80: check valve | 81: check spring |
| 90: stopper | 91: head portion |
| 93: body portion | 100: reset valve |
| 110: oil passing groove | 120: reset spring |
| 121: spring pin | 130: reset guide module |
| 131: guide plate | 133: connecting bracket |
| 135: mount hole | 137: guide rod |

What is claimed is:

1. A compression-release engine brake for opening an exhaust valve at an end of a compression stroke of an engine, the compression-release engine brake comprising:

an exhaust rocker arm configured to rotate around a rocker arm shaft by a rotation of an exhaust cam that is configured to selectively contact a roller mounted at a first end of the exhaust rocker arm;

a valve bridge disposed on a second end of the exhaust rocker arm and connected to a pair of exhaust valves, the valve bridge configured to include a pair of rotation preventers protruded outward;

a socket module disposed between the exhaust rocker arm and the valve bridge, and including a housing configured to form a first space in which an engine brake oil flows in through an inlet, and a second space from which the engine brake oil is exhausted through an outlet;

a reset valve partially inserted in the second space of the housing; and a reset guide module mounted on an upper part of a cylinder head and configured to selectively push the reset valve inside of the housing to exhaust the engine brake oil, wherein the pair of rotation preventers of the valve bridge are protruded toward an outside from a central portion of the valve bridge and extended to contact a part corresponding to the second space of the socket module, and wherein the pair of rotation preventers prevent rotation of the socket module.

2. The compression-release engine brake of claim 1, wherein the socket module further includes: a brake piston configured to move up and down by the engine brake oil inserted into the first space, and configured to contact an upper surface of the valve bridge.

3. The compression-release engine brake of claim 2, wherein:

an upper protrusion and a lower protrusion are formed on each exterior surface of the brake piston, a stopper is inserted through a side of the housing, and an end portion of the stopper is disposed between the upper protrusion and the lower protrusion.

4. The compression-release engine brake of claim 3, wherein:

the stopper further includes a head portion and a body portion, and the body portion is inserted through the housing, and the end portion of the stopper is protruded into the first space by a predetermined length to be positioned between the upper protrusion and the lower protrusion.

5. The compression-release engine brake of claim 2, further comprising a check valve provided in the first space and configured to open and close the inlet.

6. The compression-release engine brake of claim 5, further comprising a check spring provided on an upper portion of the brake piston and configured to elastically support the check valve.

7. The compression-release engine brake of claim 6, wherein an upper end of an oil passing groove is caught on a slanted surface formed in the second space for preventing the reset valve from deviating downward.

8. The compression-release engine brake of claim 2, wherein:

the reset valve has a flow path groove that is concave inward from an upper exterior circumference of the reset valve; and a reset spring is configured to elastically support the reset valve.

9. The compression-release engine brake of claim 8, wherein the reset valve is configured to open the outlet when the reset valve contacts a guide rod.

10. The compression-release engine brake of claim 1, wherein the housing further includes a rounded mounting groove protruded upward from an upper center of the housing where an adjusting screw is mounted.

11. The compression-release engine brake of claim 1, wherein:

penetration holes are formed in side surfaces of the housing on which the pair of rotation preventers contract the housing; and a part of the engine brake oil is exhausted through the penetration holes.

12. The compression-release engine brake of claim 1, wherein the reset guide module comprises:

a guide plate in which the pair of exhaust valves are fitted and seated on the upper part of the cylinder head;

a connection bracket formed on the guide plate; and a guide rod mounted on the connecting bracket and configured to selectively push the reset valve.

* * * * *